US007645121B2

(12) United States Patent
Tudor

(10) Patent No.: US 7,645,121 B2
(45) Date of Patent: Jan. 12, 2010

(54) BLADE AND ROTOR ARRANGEMENT

(75) Inventor: David J. Tudor, Derby (GB)

(73) Assignee: Rolls Royce PLC, London (GB)

( * ) Notice: Subject to any disclaimer, the term of this patent is extended or adjusted under 35 U.S.C. 154(b) by 598 days.

(21) Appl. No.: 11/640,839

(22) Filed: Dec. 19, 2006

(65) Prior Publication Data

US 2007/0160459 A1 Jul. 12, 2007

(30) Foreign Application Priority Data

Jan. 12, 2006 (GB) ..... 0600532.6

(51) Int. Cl.
*F01D 25/24* (2006.01)

(52) U.S. Cl. ..... 415/220; 411/119; 411/914

(58) Field of Classification Search ..... 415/220, 415/221, 119, 914
See application file for complete search history.

(56) References Cited

U.S. PATENT DOCUMENTS

| | | | | |
|---|---|---|---|---|
| 4,063,848 | A | 12/1977 | Wiggins et al. | |
| 4,466,772 | A * | 8/1984 | Okapuu et al. | 415/173.5 |
| 5,707,206 | A * | 1/1998 | Goto et al. | 415/173.1 |
| 6,499,940 | B2 * | 12/2002 | Adams | 415/9 |
| 6,619,909 | B2 * | 9/2003 | Barnett et al. | 415/57.4 |
| 2003/0138317 | A1 | 7/2003 | Barnett et al. | |

FOREIGN PATENT DOCUMENTS

| | | |
|---|---|---|
| EP | 0 754 864 A1 | 1/1997 |
| EP | 1 101 947 A3 | 5/2001 |
| GB | 2 023 733 A | 1/1980 |
| GB | 2 092 681 A | 8/1982 |
| GB | 2 146 707 A | 4/1985 |
| GB | 2 158 879 A | 11/1985 |

OTHER PUBLICATIONS

International Search Report performed on Apr. 7, 2006.

* cited by examiner

*Primary Examiner*—Ninh H Nguyen
(74) *Attorney, Agent, or Firm*—Oliff & Berridge PLC

(57) ABSTRACT

A fan rotor arrangement comprises a fan rotor (24) and a plurality of fan blades (26). Each fan blade (26) comprises a root portion (36) and an aerofoil portion (38). Each aerofoil portion (38) has a leading edge (44), a trailing edge (46) and a tip (48). Concave pressure surface (50) and convex suction surface (52) extend from the leading edge (44) to the trailing edge (46) of each aerofoil portion (38). An annular wall (54) surrounds the fan rotor (24) and fan blades (26) and an inner surface (56) of the annular wall (54) has a circumferentially extending groove (58). The circumferentially extending groove (58) is arranged axially, or chordally, between the leading edges (44) and the trailing edges (46) at the tips (48) of the aerofoil portions (38) of the fan blades (26). The circumferentially extending groove (58) extends axially by at least half a wavelength of an unsteady pressure wave to provide a geometrically tuned cavity and additionally pressure loss to suppress axially upstream propagating unsteady pressure waves. This reduces vibrations of the fan blade (26).

13 Claims, 5 Drawing Sheets

BLADE AND ROTOR ARRANGEMENT

The present invention relates to a rotor arrangement, and in particular to a fan rotor arrangement for a turbofan gas turbine engine.

Small tip chord turbofan clapper less fan blades may suffer from vibration where altitude aerodynamic forces lead to excitation of a fan blades natural modes of vibration, e.g. second flap mode, away from coincidence with the harmonics of a fan blades rotational speed, i.e. a non integral vibration. At high fan blade rotational speeds, forward propagating pressure waves normal to passage shock waves are formed in the passages defined circumferentially between the radially outer tips of adjacent fan blades and bounded by the fan casing which provides useful compression of the air flow. However, at altitudes greater than about 40000 ft, 12200 m, and over specific speed ranges, greater than about 1500 $fts^{-1}$, 457 $ms^{-1}$ and fan blades having a tip chord length of less than 300 mm, excitation of natural modes of vibration of the fan blades due to unsteady motion of the shock waves has led to divergent fan blade vibration.

These unsteady pressure waves from the normal to the passage shock propagate in an upstream direction in the passages between the tips of the fan blades in the high Mach No. flow. These unsteady pressure waves are of concern where the pressure waves have short wavelengths approximating to 0.5, 1.5, 2.5 times the chord wise length of the passage between the tips of adjacent fan blades, the passage length extends from the leading edge to the trailing edge of adjacent fan blades. These unsteady pressure waves may provide anti-phase excitation of leading edge motion of the fan blades. If there is a coincidence of the mode shape, e.g. significant leading edge motion of the fan blades within the second flap vibration mode shape, divergent blade vibration is produced, which reduces the life of the fan blades and increases the incidence of mechanical failure, e.g. cracking.

Accordingly the present invention seeks to provide a novel rotor arrangement, which at least reduces the above problem.

Accordingly the present invention provides a rotor arrangement comprising a rotor and plurality of circumferentially spaced blades extending radially outwardly from the rotor, each blade comprising an aerofoil portion, each aerofoil portion having a leading edge, a trailing edge and a tip remote from the rotor, each aerofoil having a concave pressure surface extending from the leading edge to the trailing edge and a convex suction surface extending from the leading edge to the trailing edge, a casing surrounding the rotor and blades, the casing having an inner surface facing the tips of the blades, the inner surface of the casing having a circumferentially extending groove and the circumferentially extending groove being arranged axially between the leading edges and the trailing edges of the blades, the circumferentially extending groove extending axially by a distance such that at least half a wavelength of an unsteady pressure wave fits within the groove to provide a geometrically tuned cavity to suppress upstream propagating unsteady pressure waves.

Preferably the circumferentially extending groove is arranged substantially axially midway between the leading edges and the trailing edges of the blades.

Preferably the circumferentially extending groove is arranged between 40% and 60% of the axial distance between the loading edges and the trailing edges of the blades.

Preferably the circumferentially extending groove extends axially by at least 6 mm.

Preferably the circumferentially extending groove extends axially by at least 8 mm.

Preferably the circumferentially extending groove extends axially by at most 15 mm.

Preferably the circumferentially extending groove extends radially by about 5 mm.

Preferably the circumferentially extending groove is defined by an axially upstream wall extending generally radially from the inner surface of the casing, an axially downstream wall extending generally radially from the inner surface of the casing and a radially outer wall extending generally axially between the axially upstream wall and the axially downstream wall.

Preferably the axially upstream wall and the axially downstream wall are arranged substantially perpendicular to the inner surface of the casing.

The circumferentially extending groove may have rectangular cross-section, a triangular cross-section, parallelogram cross-section or a part circular cross-section.

Preferably the circumferentially extending groove is an annular groove.

Preferably the blades are fan blades.

Preferably the blades have a tip chord length of less than 300 mm.

The present invention will be more fully described by way of example with reference to the accompanying drawings in which.

Figure 1:
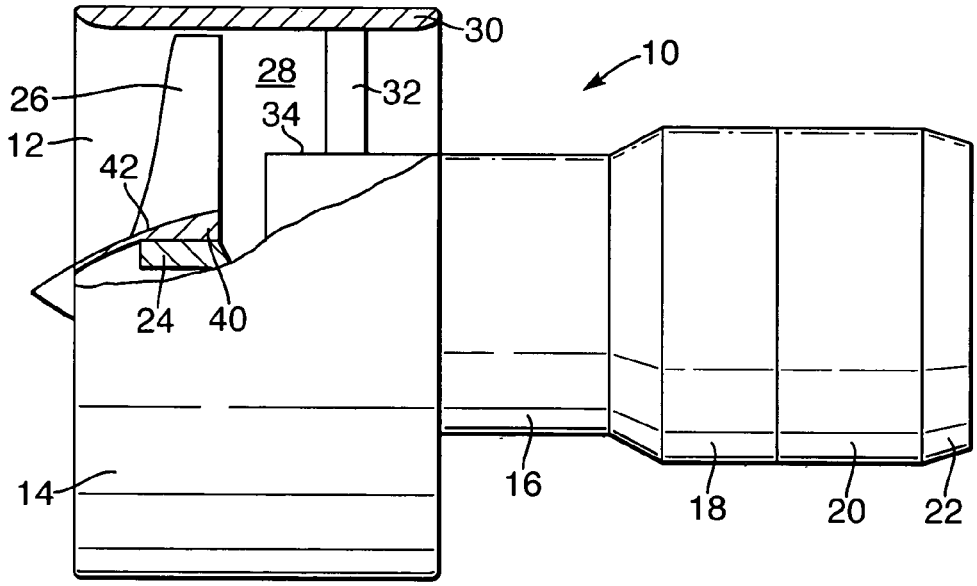
FIG. 1 shows a turbofan gas turbine engine having a fan rotor arrangement according to the present invention.

A turbofan gas turbine engine 10, as shown in FIG. 1, comprises in flow series an inlet 12, a fan section 14, a compressor section 16, a combustion section 18, a turbine section 20 and an exhaust 22. The fan section 14 comprises a fan rotor 24 carrying a plurality of circumferentially spaced radially outwardly extending fan blades 26. The fan blades 26 are arranged in a bypass duct 28 defined by a fan casing 30, which surrounds the fan rotor 24 and fan blades 26. The fan casing 30 is secured to a core engine casing 34 by a plurality of circumferentially spaced radially extending fan outlet guide vanes 32. The fan rotor 24 and fan blades 26 are arranged to be driven by a turbine (not shown) in the turbine section 20 via a shaft (not shown). The compressor section 16 comprises one or more compressors (not shown) arranged to be driven by one or more turbines (not shown) in the turbine section 20 via respective shafts (not shown).

Figure 2:
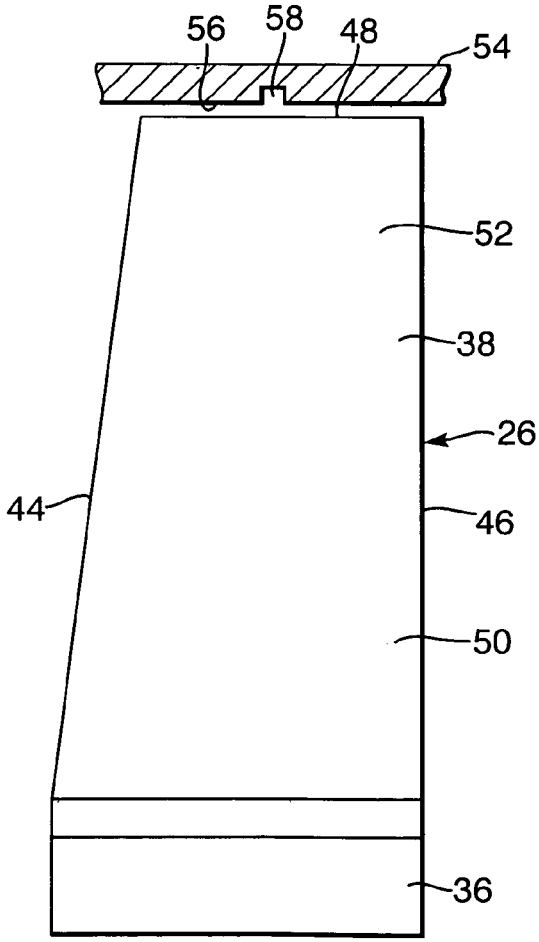
FIG. 2 shows a fan rotor arrangement according to the present invention.
Figure 3:
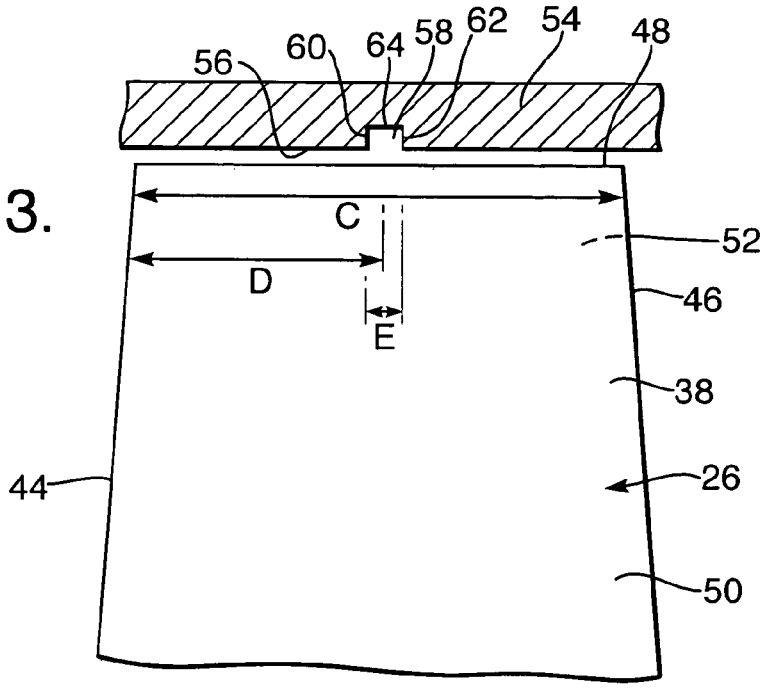
FIG. 3 shows an enlarged view of a tip of the fan blade and a fan casing shown in FIG. 2.
Figure 4:
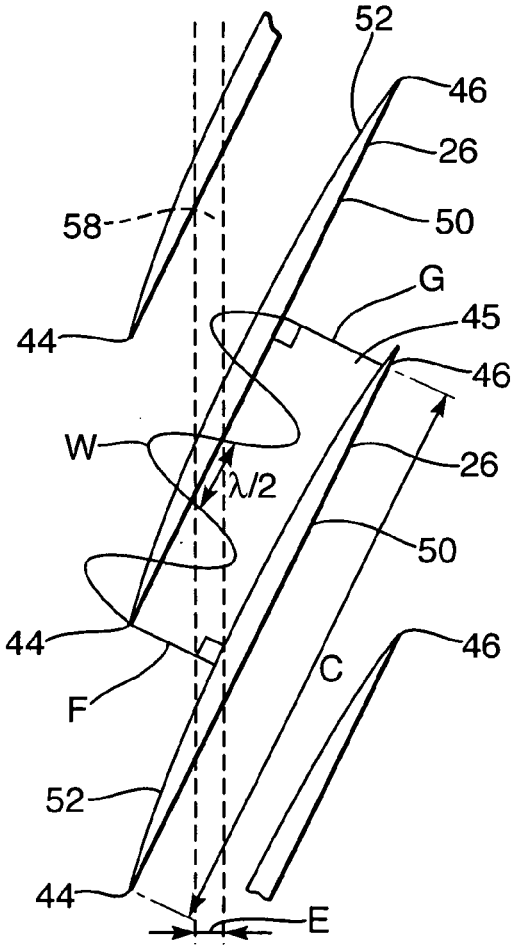
FIG. 4 is a view looking radially through the tips of adjacent fan blades showing an unsteady pressure wave.

A fan rotor arrangement according to the present invention is shown more clearly in FIGS. 2, 3 and 4. The fan blade 26 comprises a root portion 36 and an aerofoil portion 38. The root portion 36 is arranged to locate in a slot 40 in the rim 42 of the fan rotor 24, and for example the root portion 36 may be dovetail shape, or firtree shape, in cross-section and hence the corresponding slot 40 in the rim 42 of the fan rotor 24 is the same shape. The aerofoil portion 38 has a leading edge 44, a trailing edge 46 and a tip 48 remote from the root portion 36 and the fan rotor 24. A concave pressure surface 50 extends from the leading edge 44 to the trailing edge 46 and a convex suction surface 52 extends from the leading edge 44 to the trailing edge 46.

The fan rotor 24 and fan blades 26 are surrounded by a coaxial annular wall 54, forming part of the fan casing 30. The annular wall 54 has an inner surface 56 facing, and spaced radially from, the tips 48 of the fan blades 26. The inner surface 56 of the annular wall 54 has a circumferentially extending groove, an annular groove, 58. The circumferentially extending groove 58 is arranged axially, or chordally between the leading edges 44 and the trailing edges 46 at the tips 48 of the aerofoil portions 38 of the fan blades 26.

In particular the circumferentially extending groove 58 is arranged to be substantially axially, chordally, midway between the leading edges 44 and the trailing edges 46 of the tips 48 of the aerofoil portions 38 of the fan blades 26, during operation of the fan rotor 24 and fan blades 26 of the turbofan gas turbine engine 10. The circumferentially extending groove 58 extends axially, chordally, by at least half a wavelength of an unsteady pressure wave W within a passage 45 between the tips 48 of adjacent fan blades 26. The passage 45 extends from the leading edge 44 of a first fan blade 26 to the trailing edge 46 of the adjacent fan blade 26, as shown in FIG. 4.

The passage 45 may be considered as extending from a line F perpendicular to the convex surface 52 of a first fan blade 26 to the leading edge 44 of the adjacent fan blade 26 and a line G perpendicular to the concave surface 50 of the adjacent fan blade 26 to the trailing edge 46 of the first fan blade 26. The groove 58 extends axially, chordally, by a distance E such that at least half a wavelength $\lambda/2$ of the unsteady pressure wave W, within the passage 45 between the tips 48 of adjacent fan blades 26, fits within the groove 58, and a prediction of 2.5 wavelengths for the unsteady pressure wave W within the passage 45 between lines F and G is shown in FIG. 4, due to the stagger angle at the tips 48 of the fan blades 26.

The circumferentially extending groove 58 is defined by an axially upstream wall 60 extending generally radially from the inner surface 56 of the annular wall 54, an axially downstream wall 62 extending generally radially from the inner surface 56 of the annular wall 54 and a radially outer wall 64 extending generally axially between the axially upstream wall 60 and the axially downstream wall 62.

Preferably the axially upstream wall 60 and the axially downstream wall 62 are arranged substantially perpendicular to the inner surface 56 of the annular wall 54.

In one particular arrangement the circumferentially extending groove 58 extends axially by an axial distance E of at least 8 mm, the circumferentially extending groove extends radially by about 5 mm and the fan blade 26 has a chord length C at the tip 48 of the aerofoil portion 38 of less than 300 mm.

A circumferentially extending groove 58, which extends axially, or chordally, by at least half a wavelength of an unsteady pressure wave, operates to provide a geometrically tuned cavity, and additionally pressure loss, to suppress the axially upstream propagating unsteady pressure waves. The circumferentially extending groove 58, which extends axially, or chordally, by at least half a wavelength of an unsteady pressure wave, allows destructive interference to take place attenuating the amplitude of the unsteady pressure excitation in the passages between the tips 48 of the fan blades 26. The circumferentially extending groove 58 disrupts the unsteady pressure wave reinforcing the divergent non-integral fan blades 26 vibration at high speed and high altitude operation. This leads to increased life of the fan blades 26 and reduces the possibility of mechanical failure of the fan blades 26 under high altitude cruise conditions. In addition, the circumferentially extending groove 58 does not adversely affect the stall margin of the fan rotor 24 and fan blades 26.

The square edged circumferentially extending groove 58 cross-section results in a local unsmooth area distribution of the passages between the tips 48 of the fan blades 26, which contributes additional pressure loss, further attenuating the axially upstream propagating unsteady pressure waves.

The circumferentially extending groove 58 may be positioned in the annular wall 54 at any axial position between the leading edges 44 and trailing edges 46 at the tips 48 of the aerofoil portions 38 of the fan blades 26 where the peak unsteady amplitude of the axially upstream propagating pressure wave occurs. Preferably the circumferentially extending groove 58 is at an axial position D between 40% to 60% axial distance between leading edges 44 and trailing edges 46 of the tips 48 of the fan blades 26.

Figure 5A:
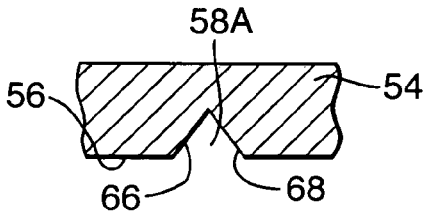
FIGS. 5A to 5F show alternative cross-sectional shapes of the groove in the fan casing.
Figure 5B:
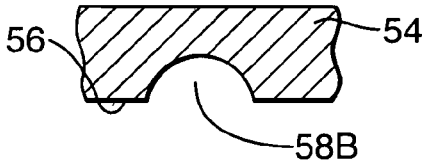
Figure 5C:
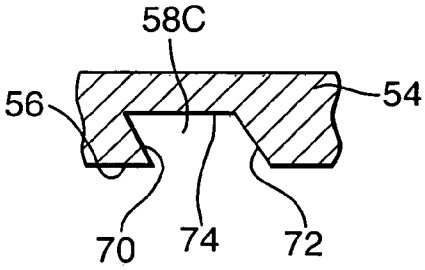
Figure 5D:
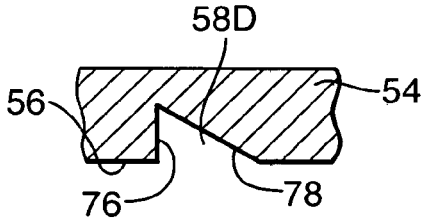
Figure 5E:
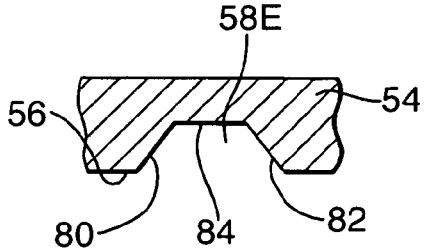
Figure 5F:
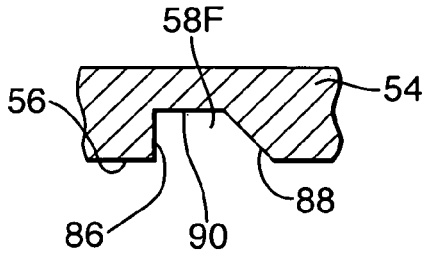

Although the present invention has been described with reference to a groove with a rectangular cross-section in a plane containing the axis of rotation of the fan rotor 24 it is also possible to use grooves with other cross-sectional shapes in a plane containing the axis of rotation of the fan rotor 24. A triangular cross-section groove 58A is shown in FIG. 5A, and the groove 58A comprises two walls 66, 68 angled to the radial direction e.g. angled to a plane perpendicular to the axis of the fan rotor 26. A part circular cross-section groove 58B is shown in FIG. 4B. A parallelogram cross-section groove 58C is shown in FIG. 4C, and the groove 58C comprises an axially upstream wall 70, an axially downstream wall 72 and a radially outer wall 74 extending generally axially between the walls 70 and 72. The walls 70 and 72 are angled to the radially direction. A triangular cross-section groove 58D is show in FIG. 4D, and the groove 58D comprises an axially upstream wall 76 extending generally radially and a wall 78 angled to the radial direction. A further groove 58E as shown in FIG. 4E comprises an axially upstream wall 80, an axially downstream wall 82 and a radially outer wall 82 extends axially between the walls 80 and 82. The walls 80 and 82 are angled to the radial direction. Another groove 58F as shown in FIG. 4F comprises an axially upstream wall 86, an axially downstream wall 88 and a radially outer 90 extending axially between the walls 86 and 88. The wall 86 extends generally radially and the wall 77 is angled to the radial direction. The embodiments in FIGS. 4C, 4D and 4F reduce or prevent recirculation of air over the tips 48 of the fan blades 26.

Although the present invention has been described with reference to a fully annular groove it may be equally possible to provide a plurality of circumferentially extending but circumferentially spaced grooves, however, this is not an optimum design.

Figure 6A:
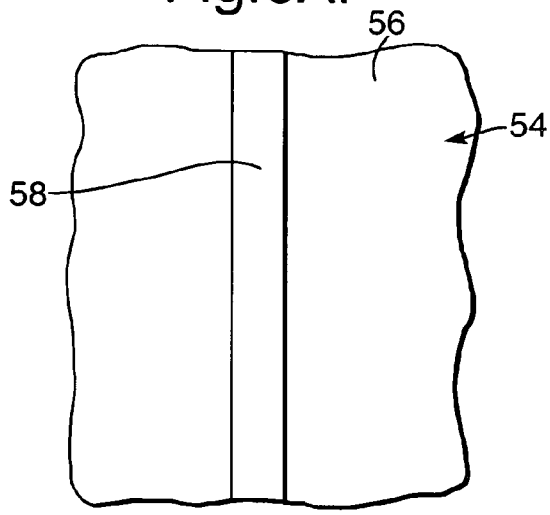
FIGS. 6A to 6E show alternative shapes of the groove in the fan casing.
Figure 6B:
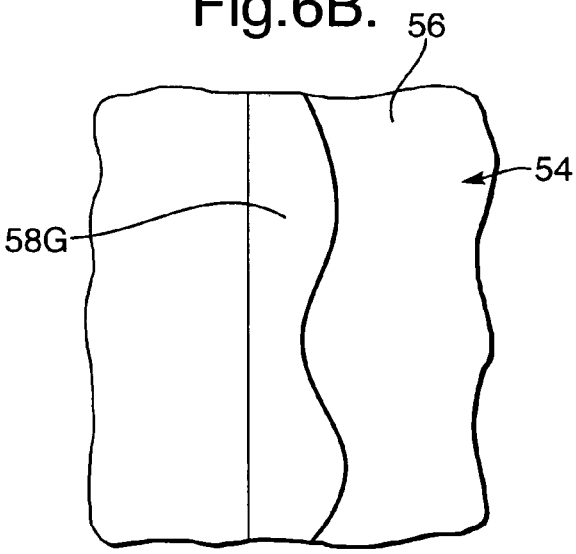
Figure 6C:
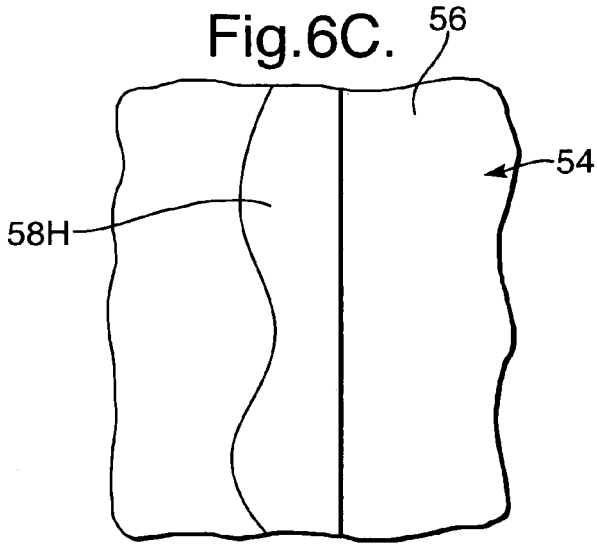
Figure 6D:
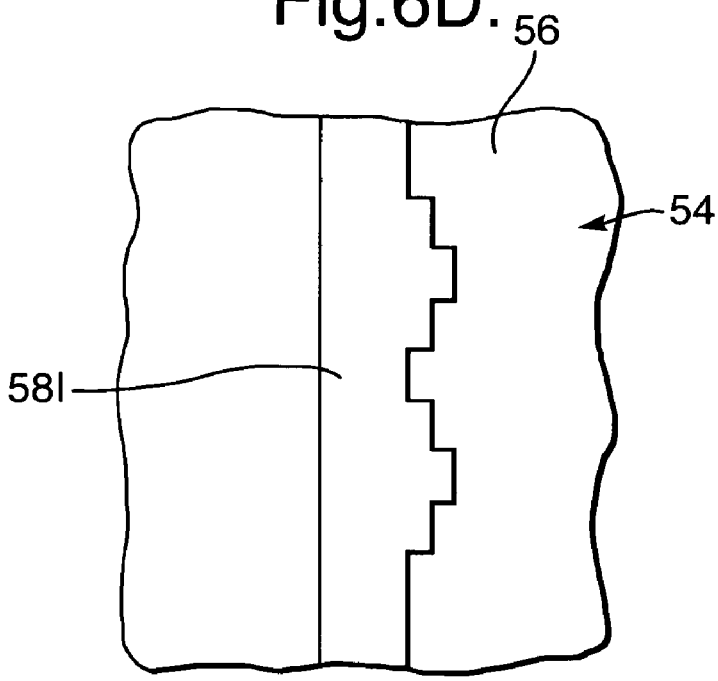

It is preferred that the circumferentially extending groove 58 has the same axial dimension circumferentially around the fan casing 54 as shown in FIG. 6A, however, the axial dimension of the groove may vary circumferentially around the fan casing to take into account different wavelengths. The change in axial dimension may be a continuous smooth change by having a sinusoidal axially downstream wall and a straight axially upstream wall in a plane perpendicularly to the axis of the fan rotors 26 as shown by groove 58G in FIG. 6B or visa-versa as shown by groove 58H in FIG. 6C or a stepped change as shown by groove 58I in FIG. 6D.

Figure 6E:
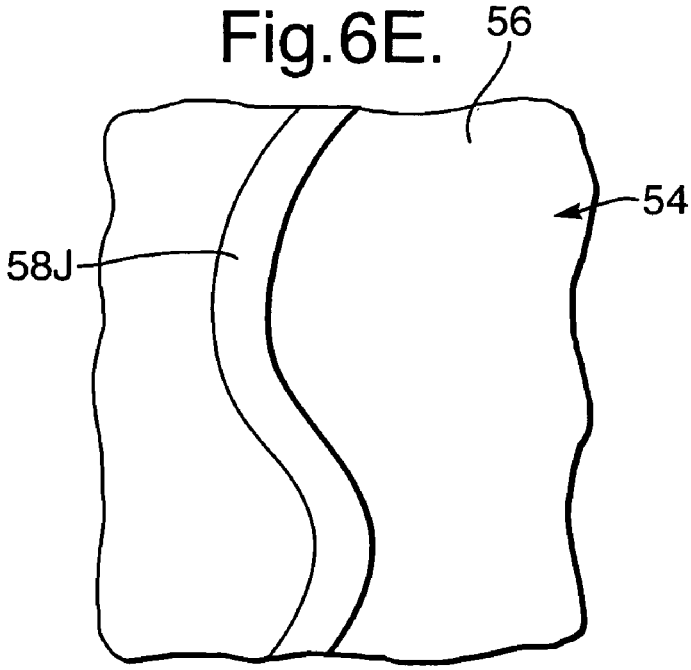

It may be possible for the circumferentially extending groove 58J to be sinusoidal and have two sinusoidal walls as in FIG. 6E.

It may be possible to provide two or more axially spaced circumferentially extending grooves in the casing to attenuate the unsteady pressure wave.

The axial length of the circumferential groove may be between 6 mm and 15 mm depending on the chord length of the tip of the fan blade, specific examples of axial length are 8 mm and 13 mm.

The present invention may also be applicable to other compressor rotors and compressor blades.

I claim:

1. A rotor arrangement comprising a rotor and plurality of circumferentially spaced blades extending radially outwardly from the rotor, each blade comprising an aerofoil portion, each aerofoil portion having a leading edge, a trailing edge and a tip remote from the rotor, each aerofoil having a concave pressure surface extending from the leading edge to the trailing edge and a convex suction surface extending from the leading edge to the trailing edge, a casing surrounding the rotor and blades, the casing having an inner surface facing the tips of the blades, the inner surface of the casing having a circumferentially extending groove and the circumferentially extending groove being arranged axially between the leading edges and the trailing edges of the blades, the circumferentially extending groove extending axially by a distance such that at least half a wavelength of an unsteady pressure wave fits within the groove to provide a geometrically tuned cavity to suppress the upstream propagating unsteady pressure waves.

2. A rotor arrangement as claimed in claim 1 wherein the circumferentially extending groove is arranged between 40% and 60% of the axial distance between the leading edges and the trailing edges of the blades.

3. A rotor arrangement as claimed in claim 1 wherein the circumferentially extending groove is arranged substantially axially midway between the leading edges and the trailing edges of the blades.

4. A rotor arrangement as claimed in claim 1 wherein the circumferentially extending groove extends axially by at least 6 mm.

5. A rotor arrangement as claimed in claim 1 wherein the circumferentially extending groove extends axially by at least 8 mm.

6. A rotor arrangement as claimed in claim 1 wherein the circumferentially extending groove extends axially by at most 15 mm.

7. A rotor arrangement as claimed in claim 1 wherein the circumferentially extending groove extends radially by about 5 mm.

8. A rotor arrangement as claimed in claim 1 wherein the circumferentially extending groove is defined by an axially upstream wall extending generally radially from the inner surface of the casing, an axially downstream wall extending generally radially from the inner surface of the casing and a radially outer wall extending generally axially between the axially upstream wall and the axially downstream wall.

9. A rotor arrangement as claimed in claim 8 wherein the axially upstream wall and the axially downstream wall are arranged substantially perpendicular to the inner surface of the casing.

10. A rotor arrangement as claimed in claim 1 wherein the circumferentially extending groove has a rectangular cross-section, a triangular cross-section, a parallelogram cross-section or a part circular cross-section.

11. A rotor arrangement as claimed in claim 1 wherein the circumferentially extending groove is an annular groove.

12. A rotor arrangement as claimed in claim 1 wherein the blades are fan blades.

13. A rotor arrangement as claimed in claim 1 wherein the blades have a tip chord length of less than 300 mm.

* * * * *